US008858898B2

(12) United States Patent
Yu

(10) Patent No.: US 8,858,898 B2
(45) Date of Patent: Oct. 14, 2014

(54) PIPETTE TIP WITH IMPROVED SEAL

(71) Applicant: Gene Era Biotech Co. Ltd., Hangzhou (CN)

(72) Inventor: Weiming Yu, Hangzhou (CN)

( * ) Notice: Subject to any disclaimer, the term of this patent is extended or adjusted under 35 U.S.C. 154(b) by 0 days.

(21) Appl. No.: 13/831,931

(22) Filed: Mar. 15, 2013

(65) Prior Publication Data

US 2013/0309144 A1 Nov. 21, 2013

Related U.S. Application Data

(63) Continuation of application No. PCT/CN2012/079494, filed on Aug. 1, 2012.

(51) Int. Cl.
*B01L 3/02* (2006.01)

(52) U.S. Cl.
CPC ..... *B01L 3/0275* (2013.01); *B01L 3/02* (2013.01); *B01L 2200/0689* (2013.01); *B01L 2300/123* (2013.01)
USPC ..... 422/525; 422/524

(58) Field of Classification Search
CPC ..... B01L 3/02
USPC ..... 422/524, 525
See application file for complete search history.

(56) References Cited

U.S. PATENT DOCUMENTS

| | | | | |
|---|---|---|---|---|
| 5,660,797 | A * | 8/1997 | Jarvimaki | 422/525 |
| 8,202,495 | B1 * | 6/2012 | Smith | 422/524 |
| 2012/0213677 | A1 * | 8/2012 | Petrek | 422/525 |

OTHER PUBLICATIONS

Definition of near, http://www.thefreedictionary.com/near, Jul. 26, 2014.*

* cited by examiner

*Primary Examiner* — Jan Ludlow
(74) *Attorney, Agent, or Firm* — Jun He Law Offices P.C.; James J. Zhu

(57) ABSTRACT

The present invention provides a pipette tip member with improved seal.

12 Claims, 2 Drawing Sheets

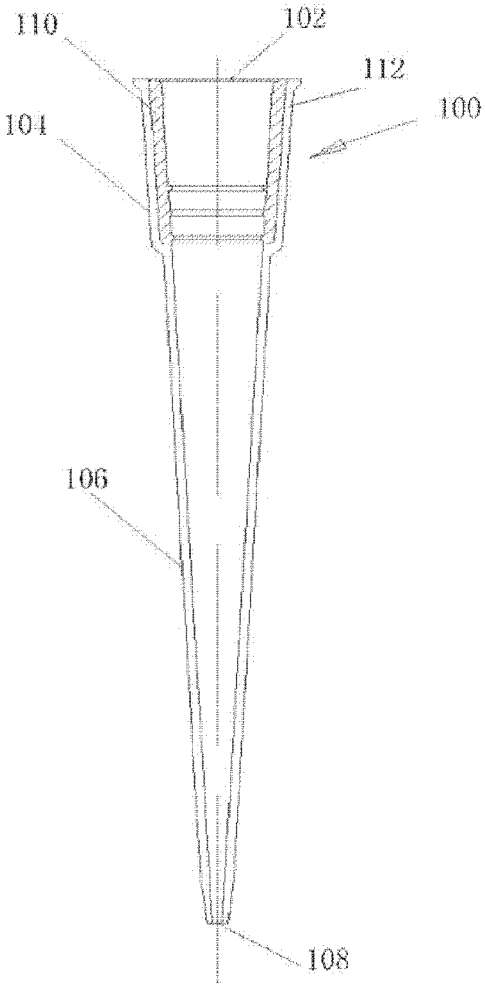
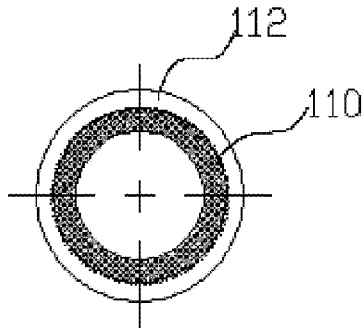
FIG. 1A
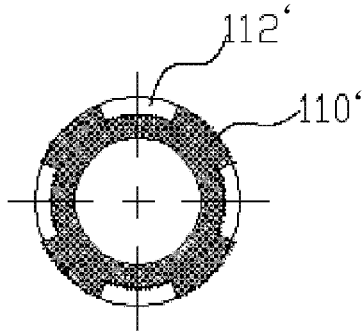
FIG. 1B
FIG. 1

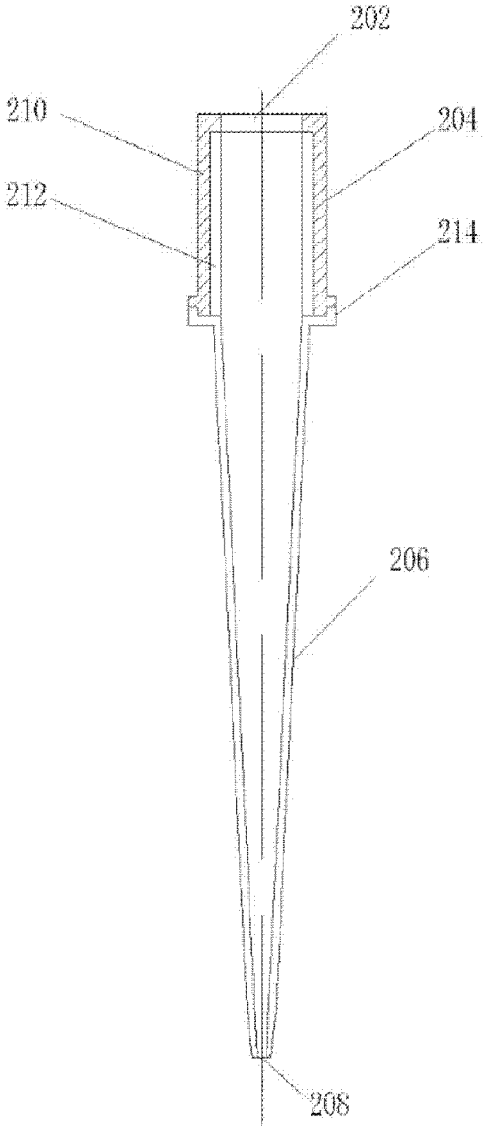
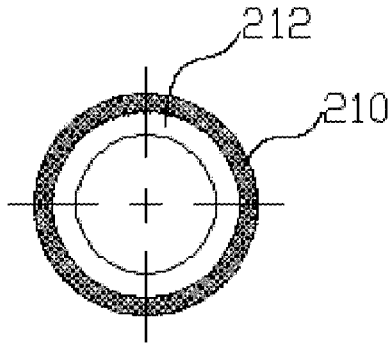
FIG. 2A
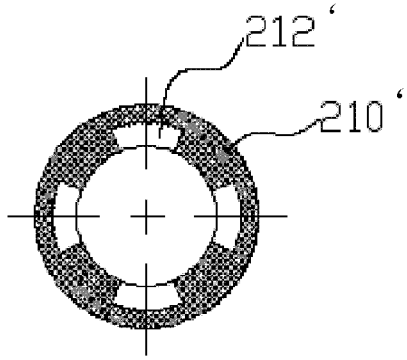
FIG. 2B
FIG. 2

PIPETTE TIP WITH IMPROVED SEAL

CROSS REFERENCE TO RELATED APPLICATION

This is a continuation application of PCT/CN2012/079494 filed on Aug. 1, 2012, which claims the priority of the Chinese Application No. 201210154024.3 filed on May 16, 2012, the entire content of which is hereby incorporated herein by reference.

FIELD OF THE INVENTION

The present invention generally relates to removable pipette tips for transfer liquids, and particularly to pipette tips with improved seal.

BACKGROUND OF THE INVENTION

Molecular biology experiments are increasingly in low reaction volumes in the ranges of several microliters. Transferring and dispensing precise low volumes of liquids are typically conducted with a pipette using micropipette tips. For precision in the quantity of the transferred liquid, it is quintessential to have annular tight seal between the tip and the pipette shaft engaging a tip. Efforts have been made in the art to improve sealing effect in pipette tips. For example, U.S. Pat. Nos. 4,748,859 and 7,047,828 disclose specially designed pipette tip members for improved sealing contact with a pipette shaft. However, there is a continued need for further improvement.

SUMMARY OF THE INVENTION

The present invention provides a pipette tip member with improved seal. In particular, a pipette tip member is provided for picking up and dispensing liquid when used in conjunction with a pipette device. Generally speaking, the pipette tip member is capable of releasably mating with a pipette shaft and includes an elongated tubular receptacle. The elongated tubular receptacle comprises a larger proximal tip opening, a smaller distal tip opening for dispending liquid from the pipette tip member, and an upper wall section and a lower wall section disposed between the proximal and distal openings. The upper wall section is adjacent the proximal tip opening for removably engaging a pipette shaft and is formed of at least two overlapping and coaxial layers: a sealing layer and a supporting layer. When the pipette tip is mounted onto a pipette shaft the sealing layer is in sealing contact with the pipette shaft. Generally, the supporting layer has a greater hardness (as measured according to ASTM test D 2240) than the sealing layer. Preferably, the sealing layer and the supporting layer are coaxial and concentric. Also preferably, the two layers are permanently joined together.

The foregoing and other advantages and features of the invention, and the manner in which the same are accomplished, will become more readily apparent upon consideration of the following detailed description of the invention taken in conjunction with the accompanying examples, which illustrate preferred and exemplary embodiments.

BRIEF DESCRIPTION OF THE DRAWINGS

FIG. 1 is a sectional view of one preferred embodiment of a pipette tip member;

FIG. 1A is a horizontal cross-sectional view of the upper wall section of one specific embodiment of the pipette tip member in FIG. 1;

FIG. 1B is a horizontal cross-sectional view of the upper wall section of another specific embodiment of the pipette tip member of FIG. 1;

FIG. 2 is sectional view of another preferred embodiment of a pipette tip member;

FIG. 2A is a horizontal cross-sectional view of the upper wall section of one specific embodiment of the pipette tip member in FIG. 2;

FIG. 2B is a horizontal cross-sectional view of the upper wall section of another specific embodiment of the pipette tip member in FIG. 2.

DETAILED DESCRIPTION OF THE PREFERRED EMBODIMENTS

Accordingly, the present invention provides a pipette tip member with an improved sealing effect when mated with a pipette shaft. Generally speaking, the pipette tip member includes an elongated tubular receptacle that comprises a proximal opening for receiving a pipette shaft, a distal tip opening for picking up and dispending liquid from the pipette tip member, and an upper wall section and a lower wall section disposed between the proximal and distal openings. The upper wall section adjacent the proximal tip opening defines the proximal tip opening at its edge portion, and can removably engage a pipette shaft. The upper wall section comprises a side wall having at least a sealing layer and a supporting layer. When the pipette tip is mounted onto a pipette shaft the sealing layer is in sealing contact with the pipette shaft. The supporting layer has a greater hardness (as measured according to ASTM test D 2240) than the sealing layer. Preferably, the supporting layer also has a greater compression set (as measured according to ASTM D395 Method B) than the sealing layer. Preferably, the sealing layer and the supporting layer are coaxial and concentric. Also preferably, the two layers are permanently joined together. Typically, the supporting layer and the sealing layer have different polymeric compositions.

In one embodiment, the pipette tip member has the sealing layer on an inner peripheral surface of the upper wall section and around an entire circumference. The sealing layer may be on an inner peripheral surface of the upper wall section and forms an annular region that extends axially, and preferably continuously, along at least 10%, 20%, 30%, 40%, 50%, 60%, 70% or at least 80% of the entire axial or longitudinal length of the upper wall section. Preferably, the sealing layer is coextensive with the upper wall section, i.e., covers the entire axial or longitudinal length of the upper wall section. Alternatively, the sealing layer comprises one, two or more coaxial annular bands axially spaced apart on the supporting layer, each covering a portion of the supporting layer of the upper wall section, but around the entire circumference of the portion. In yet another alternative, the sealing layer is a continuous layer around the entire circumference of a portion of the upper wall section, while the supporting layer comprises two, three, four, five, or eight or more elongated strips or sections circumferentially spaced apart either on the sealing layer or embedded within the sealing layer, each extending axially along the portion of the upper wall section.

In a specific embodiment, the inner surface of the upper wall section, that is, the surface of the elastic sealing layer, has an axial taper to the axis of the elongated tubular receptacle. In other words, the inner surface of the upper wall section may have a conical elastic inner surface, which helps to prevent excess downward sliding movement of a pipette shaft inserted into the pipette tip member and provide a fluid-tight sealing contact with the pipette shaft. The uniform axial taper may be from about 30' to about 5°, e.g., 3°30' to the axis of the elongated tubular receptacle. Optionally, the upper wall section comprises an internal shoulder near the distal end of the upper wall section sufficient to prevent, reduce or stop excess downward sliding movement of a pipette shaft inserted into the pipette tip toward the distal opening of the pipette tip member. The internal shoulder may be one or more inwardly extending flanges, but preferably an annular ridge extending inwardly toward the axis of the elongated tubular receptacle of the pipette tip member.

In another embodiment, the pipette tip member has the sealing layer on an outer peripheral surface of the upper wall section and around an entire circumference. Thus, this embodiment of the pipette tip member is suitable to mate with a hollow shaft of a pipette device, e.g., a robotic pipette, such that the outer sealing layer of the pipette tip member is in sealing contact with the inner surface of the hollow shaft. The sealing layer forms an annular region that extends axially, and preferably continuously, along at least 10%, 20%, 30%, 40%, 50%, 60%, 70% or at least 80% of the entire longitudinal length of the upper wall section. Preferably, the sealing layer is coextensive with and covers the entire surface of the upper wall section. Alternatively, the sealing layer comprises one, two or more coaxial annular rings or bands spaced axially apart each covering a portion of the supporting layer but around the entire circumference of the portion. In yet another alternative, the sealing layer is a continuous layer around the entire circumference of a portion of the upper wall section, while the supporting layer comprises two, three, four, five, or eight or more elongated strips or sections circumferentially spaced apart either on the sealing layer or embedded within the sealing layer, each extending axially along the portion of the upper wall section.

In a specific embodiment, the upper wall section includes an external shoulder near the distal end of the upper wall section sufficient to prevent, reduce or stop further downward sliding movement of a pipette shaft toward the distal tip opening. The external shoulder may be one or more radially outwardly extending flanges, but preferably an annular ridge extending outwardly around an entire circumference.

In the various aspects and the embodiments thereof, the sealing layer may have a compression factor of from about 1.5:1 to about 3:1. The sealing layer may have a compression set of less than about 30%, preferably less than 20%, more preferably less than 10%, and most preferably less than 5%, as measured according to ASTM D395 Method B. The sealing layer may have a hardness of from about 30 to about 90 Shore A, preferably about 35 to about 80 Shore A, about 40 to about 75 or 80 Shore A, about 40 to about 70 Shore A, more preferably about 40 to about 50 or 60 Shore A, as measured by ASTM test D 2240. Examples of polymer materials useful for forming the sealing layer include, but are not limited to, polyethylene (PE) (especially low density polyethylene or LDPE), polyurethane (PU), thermoplastic polyurethanes (TPU), thermoplastic elastomers (TPE), thermoplastic polyolefin (TPO), styrenic thermoplastic elastomers (S-TPEs), thermoplastic rubber (TPR), poly[styrene-b-(ethylene-co-butylene)-b-styrene] (SEBS), thermoplastic vulcanizates (TPV), styrene-butadiene-styrene (SBS), flexible PVC (elPVC), etc. In preferred embodiments, the sealing layer is made of one or more of TPE, TPU and PVC, preferably TPE or TPU or both.

The non-sealing layer parts of the pipette tip member including the supporting layer are generally intended to be supportive and to maintain the shape and rigidity. In some embodiments, the supporting layer may have a hardness of greater than about 20 Shore D or greater than about 30 Shore D, as measured by ASTM test D 2240. In some embodiments, the supporting layer has a hardness of from about 30 to about 90 Shore D, as measured by ASTM test D 2240. In some embodiments, the supporting layer has a compression set of at least about 20%, or at least 30%. Examples of polymer materials for forming the supporting layer include, but are not limited to, polypropylene (PP), polycarbonate (PC), polyvinyl chloride (PVC), acrylonitrile butadiene styrene (ABS), and polystyrene (PS).

Preferably, the polymer material for the sealing layer and the polymer material for the supporting layer are chosen such that the two polymer materials may interact with each other under the molding or bonding conditions such that the sealing layer is retentively attached onto the supporting layer. In preferred embodiments, the sealing layer is made of one or more polymer materials selected from the group of TPE, TPV and PVC, and the supporting layer is made of one or more polymers chosen from the group of polypropylene (PP), polycarbonate (PC), polyvinyl chloride (PVC), acrylonitrile butadiene styrene (ABS), and polystyrene (PS).

In preferred embodiments, the supporting layer has a hardness (ASTM test D 2240) of at least 5, preferably at least 10 Shore A greater than the sealing layer.

In various embodiments, the pipette tip member generally has a lower wall section joining the upper wall section described above. The lower wall section may be a thin-walled tapered or conical section with an angle of about 2 to about 20 degrees. In preferred embodiments, the proximal tip opening may have a diameter of from about 3 mm to about 15 mm, and the distal tip opening may have a diameter of from about 0.3 mm to about 1 mm. The total axial length of the elongated tubular receptacle of the pipette tip member may be from about 30 mm to about 160 mm. The axial length of the upper wall section may be from about 6 mm to about 15 mm, and the axial length of the lower wall section may be from about 15 mm to about 140 mm.

In preferred embodiments, the upper wall section has a wall thickness of from about 0.8 mm to about 2.5 mm, with the sealing layer being from about 0.25 mm to about 1.5 mm, and the supporting layer being from about 0.3 mm to about 2.25 mm . Also in preferred embodiments, the lower wall section may have a wall thickness of from about 0.3 mm to about 1.5 mm.

In preferred embodiments, the pipette tip member may have a volume sufficient to pick up and dispense from about 0.2 μl to less than about 5 ml of liquid.

In preferred embodiments, the supporting layer and the sealing layer should be permanently joined together, which means that they are not easily separable, and the sealing layer cannot be easily removable from the supporting layer. The pipette tip member of the present invention may be made by conventional processes, e.g., plastic-injection molding or spray-on process. In preferred embodiments, the sealing layer may be directly and retentively molded onto the supporting layer such that the sealing layer can be retained securely on top of the supporting layer. Alternatively, the sealing layer may be adhered to the supporting layer through a bonding material. The sealing layer and the supporting layer may be molded together by a dual component plastic injection molding process. Alternatively, the pipette tip member is made by a two-step molding: the non-sealing layer parts of the pipette tip member are first molded, by e.g., plastic injection molding, and then the sealing layer is directly and retentively molded onto the supporting layer.

EXAMPLES

Referring to FIG. 1, an illustrative embodiment of the pipette tip member of the present invention is shown. The elongated tubular receptacle 100 includes a larger proximal tip opening 102 for insertion of a pipette shaft in the axial direction into the pipette tip member, an upper wall section 104, a lower wall section 106, and a smaller distal tip opening 108 for drawing and dispensing liquid. The upper wall section 104 is adjacent to the proximal opening 102. Through the proximal opening 102, the distal end of a pipette shaft may be inserted into or removed from elongated tubular receptacle 100. As shown in FIG. 1, the upper wall section 104 includes at least two overlapping and coaxial layers: an inner layer which is a sealing layer 110 and an outer layer which is supporting layer 112. When the pipette tip is mounted onto a pipette shaft, the upper wall section 104 removably engages the pipette shaft, and the sealing layer 110 is in sealing contact with the peripheral surface of the pipette shaft around the entire circumference. The sealing layer 110 is resilient and made of an elastically-flexible plastic material, while the supporting layer 112 is rigid and has a hardness greater than that of sealing layer 110.

The configurations of the sealing layer and supporting layer may also take various forms. For example, in one configuration, as shown in FIG. 1A which is a horizontal cross-sectional view of the upper wall section, both the sealing layer 110 and supporting layer 112 are coaxially arranged as two overlapping layers along the entire circumference of at least a portion the upper wall section. In an alternative configuration, as shown in FIG. 1B, which is a cross section of the upper wall section, the sealing layer 110' is a continuous layer around the entire circumference, while the supporting layer 112' comprises four sections circumferentially spaced apart and integrated within the sealing layer 110', each extending axially in the upper wall section.

Optionally, as shown in FIG. 1, the peripheral surface of the sealing layer 110, that is, the inner surface of the upper wall section, has an axial taper to the axis of the elongated tubular receptacle, which may be from about 30' to about 5° , e.g., 3°30' to the axis of the elongated tubular receptacle. The taper helps to prevent excess downward sliding movement of a pipette shaft inserted into the pipette tip and provide a fluid-tight sealing contact with the pipette shaft.

FIG. 2 illustrates another embodiment of the pipette tip member. The elongated tubular receptacle 200 includes a larger proximal tip opening 202, an upper wall section 204 adjacent the proximal opening 202, a lower wall section 206, and a smaller distal tip opening 208 for drawing and dispensing liquid. As shown in FIG. 2, the upper wall section 204 includes at least two overlapping and coaxial layers: an outer layer which is a sealing layer 210 and an inner layer which is supporting layer 212. Thus, it will be apparent that the pipette tip member according to this embodiment is suitable for a pipette shaft with a hollow shaft. Specifically, when the pipette tip member according to FIG. 2 is mounted onto a pipette device, the upper wall section 204 is removably inserted into the hollow shaft of the pipette device such that the outer sealing layer 210 of the pipette tip member is in sealing contact with the inner peripheral surface of the hollow shaft. In addition, the upper wall section includes an external shoulder 214 near the distal end of the upper wall section 204 to prevent further downward sliding movement of a pipette shaft toward the distal tip opening 208. External shoulder 214 is an annular ridge extending outwardly around an entire circumference.

The configurations of the sealing layer and supporting layer may also take various forms. For example, FIG. 2A is a horizontal cross-sectional view of the upper wall section of one configuration, in which both the sealing layer 210 and supporting layer 212 are coaxially arranged as two overlapping layers along the entire circumference of at least a portion the upper wall section. Alternatively, as shown in FIG. 2B, in a cross section of upper wall section, the sealing layer 210' is a continuous layer around the entire circumference, while the supporting layer 212' comprises four sections circumferentially spaced apart and integrated within the sealing layer 210'. Each of the supporting layer section extends axially in the upper wall section.

All publications and patent applications mentioned in the specification are indicative of the level of those skilled in the art to which this invention pertains. All publications and patent applications are herein incorporated by reference to the same extent as if each individual publication or patent application was specifically and individually indicated to be incorporated by reference. The mere mentioning of the publications and patent applications does not necessarily constitute an admission that they are prior art to the instant application.

Although the foregoing invention has been described in some detail by way of illustration and example for purposes of clarity of understanding, it will be apparent that certain changes and modifications may be practiced within the scope of the appended claims.

What is claimed is:

1. A pipette tip member for releasably mating with a pipette shaft and transferring liquid, having an elongated tubular receptacle which comprises:

a proximal opening for receiving a pipette shaft;

a distal tip opening for dispending liquid from said pipette tip member; and an upper wall section adjacent said proximal opening for removably engaging said pipette shaft and having coaxially a sealing layer and a supporting layer, said upper wall section comprising an external shoulder near the distal end of said upper wall section sufficient to prevent excess downward sliding movement of said pipette shaft toward said distal tip opening, wherein said supporting layer has a greater hardness (as measured according to ASTM test D 2240) than the sealing layer, and wherein said sealing layer is on an outer peripheral surface of said upper wall section and around an entire circumference, and said sealing layer is of a length extending from said proximal opening to said shoulder, and wherein when said pipette tip member is mounted onto said pipette shaft said sealing layer is in sealing contact with an inner surface of said pipette shaft.

2. The pipette tip member of any one of claims 1, wherein said supporting layer and said sealing layer are permanently joined together.

3. The pipette tip member of claim 2, wherein said sealing layer is retentively molded directly onto said supporting layer.

4. The pipette tip member of claim 1, wherein said shoulder is an annular ridge around an entire circumference.

5. The pipette tip member of claim 1, wherein the supporting layer has a hardness (ASTM test D 2240) of at least 10 Shore A greater than the sealing layer.

6. The pipette tip member of claim 1, wherein the supporting layer and the sealing layer have different polymeric compositions.

7. The pipette tip member of claim 1, wherein the sealing layer has a compression set of less than about 10%, as measured according to ASTM D395 Method B.

8. The pipette tip member of claim 1, wherein the sealing layer has a hardness of from about 30 to about 90 Shore A, and the supporting layer has a hardness of greater than about 30 Shore D, as measured by ASTM test D 2240.

9. The pipette tip member of claim 1, wherein the sealing layer is made of TPE, TPU or both, and wherein the supporting layer is made of one or more chosen from the group of polypropylene (PP), polycarbonate (PC), polyvinyl chloride (PVC), acrylonitrile butadiene styrene (ABS), and polystyrene (PS).

10. The pipette tip member of claim 1, wherein the supporting layer has a compression set of at least 30%, as measured according to ASTM D395 Method B.

11. The pipette tip member of claim 1, wherein the sealing layer forms, on the supporting layer, one or more annular regions that extend axially for a total length that is at least 50% of the entire longitudinal length of the upper wall section.

12. The pipette tip member of claim 1, wherein said supporting layer also has a greater compression set (as measure according to ASTM D395 Method B) than the sealing layer.

* * * * *